US005439385A

United States Patent [19]

Sakai et al.

[11] Patent Number: 5,439,385

[45] Date of Patent: Aug. 8, 1995

[54] CONNECTOR FOR CIRCUIT BOARD

[75] Inventors: Hitoshi Sakai; Katsumi Koyama, both of Shizuoka, Japan

[73] Assignee: Yazaki Corporation, Tokyo, Japan

[21] Appl. No.: 181,258

[22] Filed: Jan. 13, 1994

[30] Foreign Application Priority Data

Jan. 14, 1993 [JP] Japan ..... 5-00716 U

[51] Int. Cl.[6] ..... H01R 13/00

[52] U.S. Cl. ..... 439/79; 439/83

[58] Field of Search ..... 439/79–82, 439/629, 630, 78, 83

[56] References Cited

U.S. PATENT DOCUMENTS

| | | | |
|---|---|---|---|
| 4,806,109 | 2/1989 | Manabe et al. | 439/108 |
| 5,037,314 | 8/1991 | Bricaud et al. | 439/79 |
| 5,141,445 | 8/1992 | Little | 439/79 |
| 5,173,056 | 12/1992 | Kniese et al. | 439/79 |
| 5,201,662 | 4/1993 | Roche | 439/79 |
| 5,316,489 | 5/1994 | Kachlic et al. | 439/79 |

FOREIGN PATENT DOCUMENTS

| | | |
|---|---|---|
| 61-82690 | 4/1986 | Japan . |
| 62-285376 | 12/1987 | Japan . |
| 1-166983 | 11/1989 | Japan . |

*Primary Examiner*—Larry I. Schwartz
*Assistant Examiner*—Hien D. Vu
*Attorney, Agent, or Firm*—Sughrue, Mion, Zinn, Macpeak & Seas

[57] ABSTRACT

To provide a connector for a circuit board in which terminals, before bent, have the same overall length, thereby reducing the cost of the terminals, and also preventing the erroneous mounting of the terminals on a connector housing. Distal end portions of a plurality of terminals are passed through and fixed to a connector housing, and proximal end portions of the plurality of terminals are bent, and are connected to the circuit board. The plurality of terminals, before bent, have the same overall length, and a bent portion of one of the adjacent terminals is disposed closer to the connector housing than a bent portion of the other terminal, and internal bend angle $\theta$ of the one terminal is larger than an internal bend angle $\alpha$ of the other terminal, and the proximal end portions or the distal end portions of the adjacent terminals are disposed out of phase with each other.

2 Claims, 5 Drawing Sheets

CONNECTOR FOR CIRCUIT BOARD

BACKGROUND OF THE INVENTION

1. Field of Invention

This invention relates to a connector for a circuit board in which terminals, before being bent, have the same overall length, thereby reducing the cost of producing the terminals, and also preventing erroneous mounting of the terminals on a connector housing.

2. Related Art

FIG. 8 is a vertical cross-sectional view of a conventional connector for a circuit board disclosed in Japanese Utility Model Unexamined Publication No. 1-166983, FIG. 9 is a rear view as seen in a direction of arrow B of FIG. 8, and FIG. 10 is a plan view as seen in a direction of arrow C of FIG. 8.

The circuit board connector 21 comprises a connector housing 4 of a synthetic resin, and a plurality of pin-like terminals $\mathbf{20_1}$, $\mathbf{20_2}$ . . . which have their distal end portions 23 fixedly press-fitted respectively in terminal holes 22, formed through a proximal wall 5 of the connector housing 4, in a juxtaposed manner, proximal end portions 26, 27 of these pin-like terminals being perpendicularly bent and inserted respectively in connection holes 24, formed through a circuit board 9 disposed below the connector housing 4, in a staggered manner. The connector housing 4 is fixedly secured to the circuit board 9 by screws or the like (not shown), and proximal ends 26*a*, 27*a* of the terminals are connected to land portions 25 of the circuit board 9 by solder 28.

The plurality of terminals $\mathbf{20_1}$, $\mathbf{20_2}$ . . . have two different lengths, i.e., there are longer ones and shorter ones, as shown in FIG. 11 (horizontal cross-sectional view) showing a condition before these terminals are bent. After these terminals are press-fitted in the connector housing 4, they are perpendicularly bent toward the circuit board 9, using a lower jig 29 with recesses and projections and an upper jig (not shown). As a result, as shown in FIGS. 8 and 10, the proximal end portions 26, 27 of the adjacent terminals $\mathbf{20_1}$, $\mathbf{20_2}$ are arranged out of phase with each other in a forward-backward direction, thereby preventing a short circuit between the adjacent solders 28, and also achieving a fine pitch or spacing of the distal end portions 23.

In the above conventional construction, however, two kinds of terminals $\mathbf{20_1}$, $\mathbf{20_2}$ having different lengths must be prepared, the production cost is increased, and a terminal $\mathbf{20_1}$ or $\mathbf{20_2}$ may be inadvertently press-fitted in the wrong terminal hole 24 in the connector housing 4. In the latter case, when the proximal end portion 26 (27) is bent, it may not reach the circuit board 9, and therefore cannot be connected thereto, or conversely the end portion may be too long, and interferes with a casing (not shown).

SUMMARY OF THE INVENTION

With the foregoing in view, it is an object of this invention to provide a connector for a circuit board in which an increased production cost due to different length terminals, as well as erroneous mounting of the terminals on a connector housing, are prevented.

To achieve the above object, the present invention provides a connector for a circuit board wherein distal end portions of a plurality of terminals are passed through and fixed to a connector housing; and proximal end portions of the plurality of terminals are bent, and are connected to the circuit board, wherein the plurality of terminals, before being bent, have the same overall length; a bent portion of one of the adjacent terminals is disposed closer to the connector housing than a bent portion of the other terminal; an internal bend angle of the one terminal is larger than an internal bend angle of the other terminal; and the proximal end portions or the distal end portions of the adjacent terminals are disposed out of phase with each other.

The proximal end portion of one of the terminals having the same length is bent at a point closer to the connector housing than the proximal end portion of the other terminal in such a manner that the internal bend angle of the former is larger, and as a result the proximal end portion of the one terminal and the proximal end portion of the other terminal are disposed out of phase with each other on the circuit board in a forward-backward direction, or the distal end portion of the one terminal and the distal end portion of the other terminal are disposed out of phase with each other in an upward-downward direction within the connector housing. With this arrangement, using the terminals having the same length, the proximal end portions (connection portions for the circuit board) of the terminals can be arranged in a staggered manner, or the distal end portions (electrical contact portions) of the terminals can be arranged in rows.

DETAILED DESCRIPTION OF THE PREFERRED EMBODIMENTS

Figure 1:
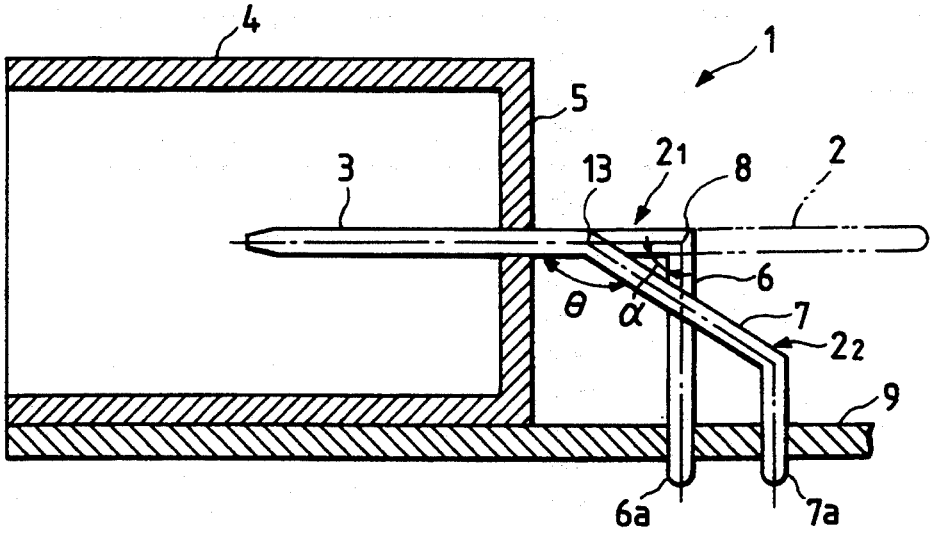
FIG. 1 is a vertical cross-sectional view of one embodiment of a circuit board connector of the present invention.
Figure 2:
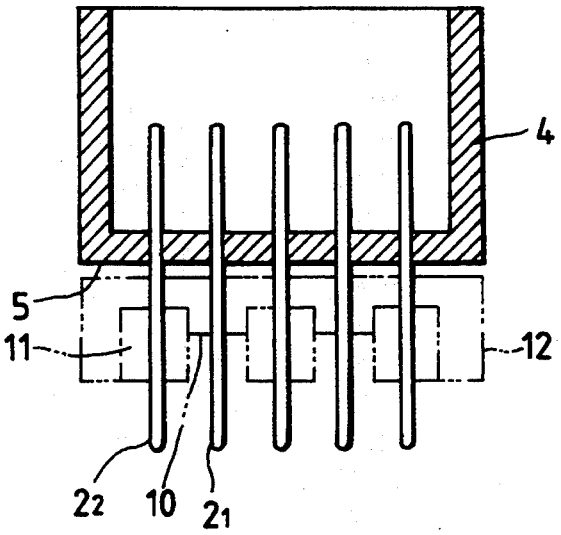
FIG. 2 is a horizontal cross-sectional view showing a condition before terminals are bent.

FIG. 1 is a vertical cross-sectional view of one embodiment of a circuit board connector of the present invention, and FIG. 2 is a horizontal cross-sectional view showing a condition before terminals are bent ( that is, a condition in which the terminals are press-fitted).

In the circuit board connector 1, a plurality of pin-like terminals 2, having the same overall length before they are bent, have their distal end portions 3 fixedly press-fitted respectively in a proximal wall 5 of a connector housing 4 in a juxtaposed manner. A proximal end portion 6 of one $2_1$ of the adjacent terminals is bent perpendicularly, and a proximal end portion 7 of the other $2_2$ of the adjacent terminals is bent at a point closer to the connector housing 4 than a bent portion 8 of the one terminal $2_1$ (that is, forwardly of this bent portion) in such a manner that an internal bend angle $\theta$ is obtuse, and is larger than an internal bend angle $\alpha$ of the one terminal $2_1$. Above a circuit board 9, a proximal end *7a* of the other terminal is bent in a direction perpendicular to the circuit-board 9, and a proximal end *6a* of the one terminal $2_1$ and the proximal end *7a* of the other terminal $2_2$ are passed through and connected to the circuit board 9 in such a manner that these two proximal ends *6a* and *7a* are disposed out of phase with each other in a forward-backward direction relative to the circuit board 9.

Figure 10:
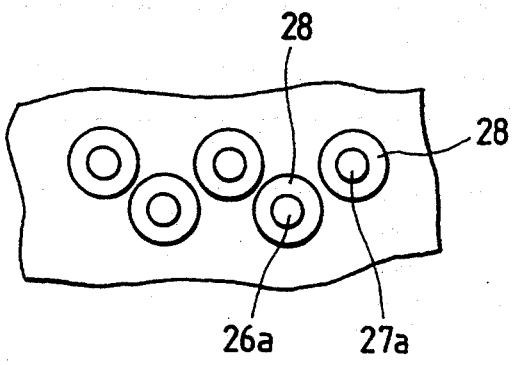
FIG. 10 PRIOR ART
FIG. 10 is a plan view as seen in a direction of arrow C of FIG. 8.
Figure 11:
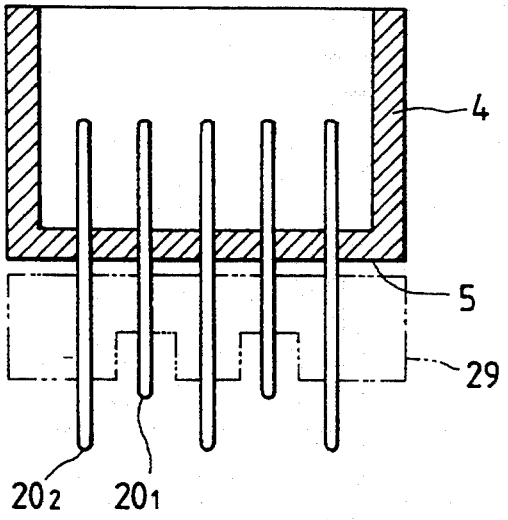
FIG. 11 PRIOR ART
FIG. 11 is a horizontal cross-sectional view in a condition before terminals are bent.

The proximal ends *6a* and *7a* of the plurality of terminals $2_1$ and $2_2$ are disposed in a staggered manner relative to the circuit board 9 as in the conventional example of FIG. 10, thereby preventing a short circuit between adjacent solders (not shown). The terminals $2_1$ and $2_2$ are bent one at a time using a lower jig 12 with alternately-arranged vertical surfaces 10 and slanting surfaces 11 and an upper jig (not shown). The other terminal $2_2$ does not need to be bent to provide straight portions, but may be curved.

Figure 3:
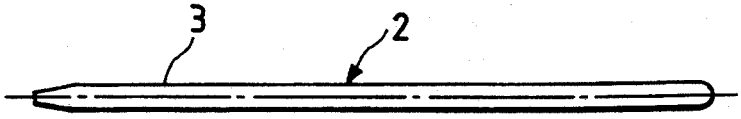
FIG. 3 is a side-elevational view of the terminal before bent.
Figure 4:
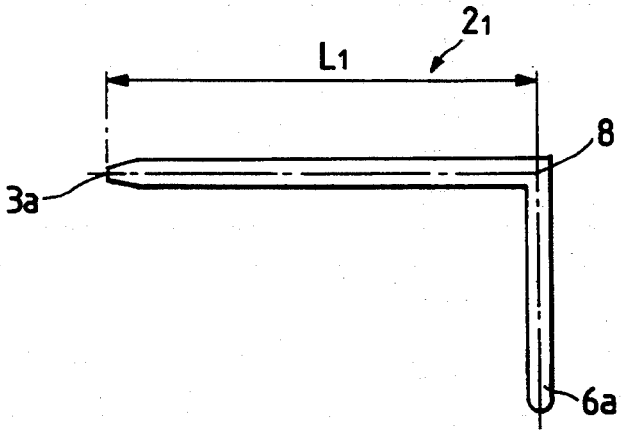
FIG. 4 is a side-elevational view of one terminal bent perpendicularly.
Figure 5:
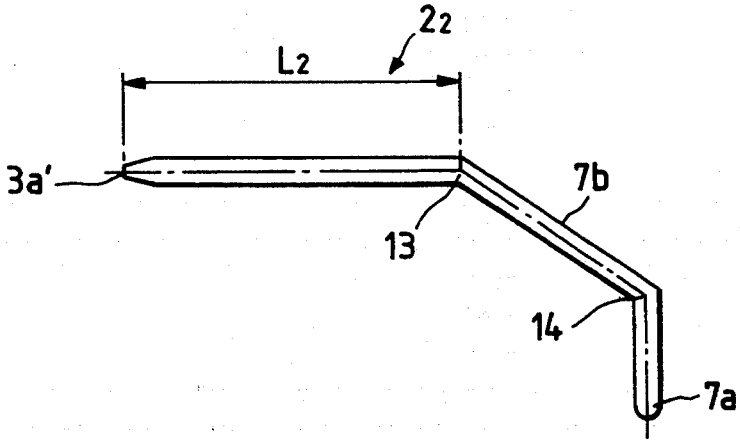
FIG. 5 is a side-elevational view of the other terminal bent in a two-stage manner.

FIGS. 3 to 5 show the configurations of the terminals. Using one kind of pin-like terminals 2 having the same overall length as shown in FIG. 3, the perpendicularly-bent terminal $2_1$ (FIG. 4) and the other terminal $2_2$ (FIG. 5) are bent in to provide straight portions by means of the above noted jigs. The distance $L_2$ from a distal end *3a'* of the terminal $2_2$ to a first bent portion 13 is shorter than the distance $L_1$ from a distal end *3a* of the terminal $2_1$ to the bent portion 8. That portion *7b* extending from the first bent portion 13 to the second bent portion 14 is slanting downwardly, and is extended rearwardly of the proximal end *6a* of the terminal $2_1$. The proximal end portion *7a* extends vertically downward from this slanting portion *7b*.

Figure 6:
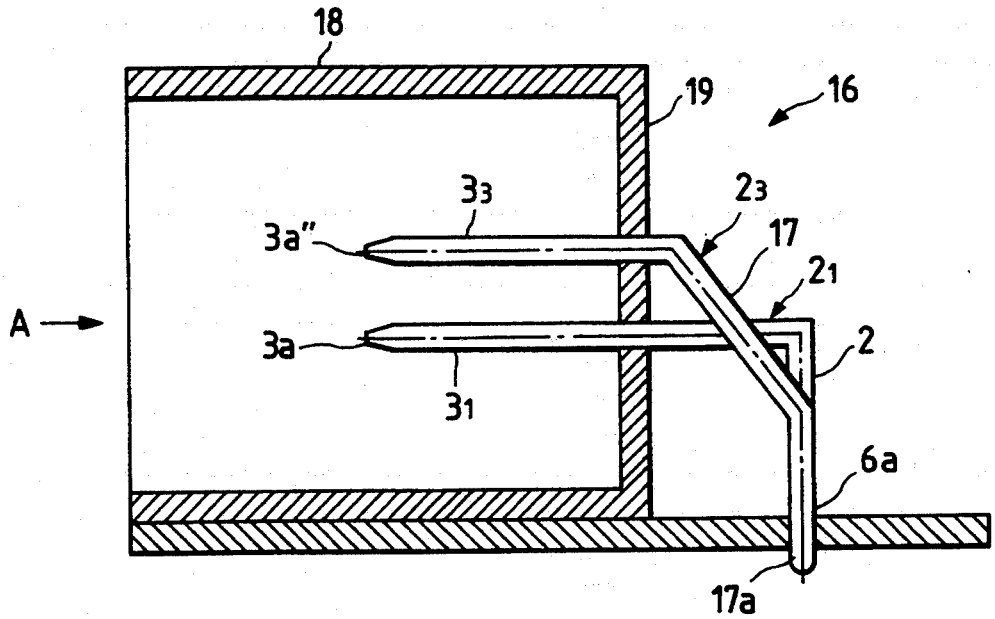
FIG. 6 is a vertical cross-sectional view of another embodiment of a circuit board connector of the present invention.

FIG. 6 is a vertical cross-sectional view of another embodiment of a circuit board connector of the present invention.

Figure 7:
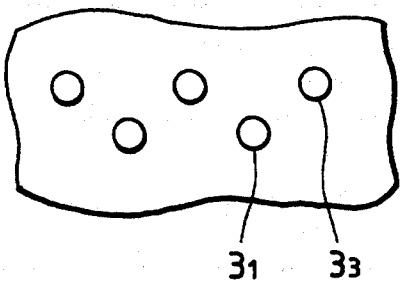
FIG. 7 is a front-elevational view as seen in a direction of arrow A of FIG. 6.
Figure 8:
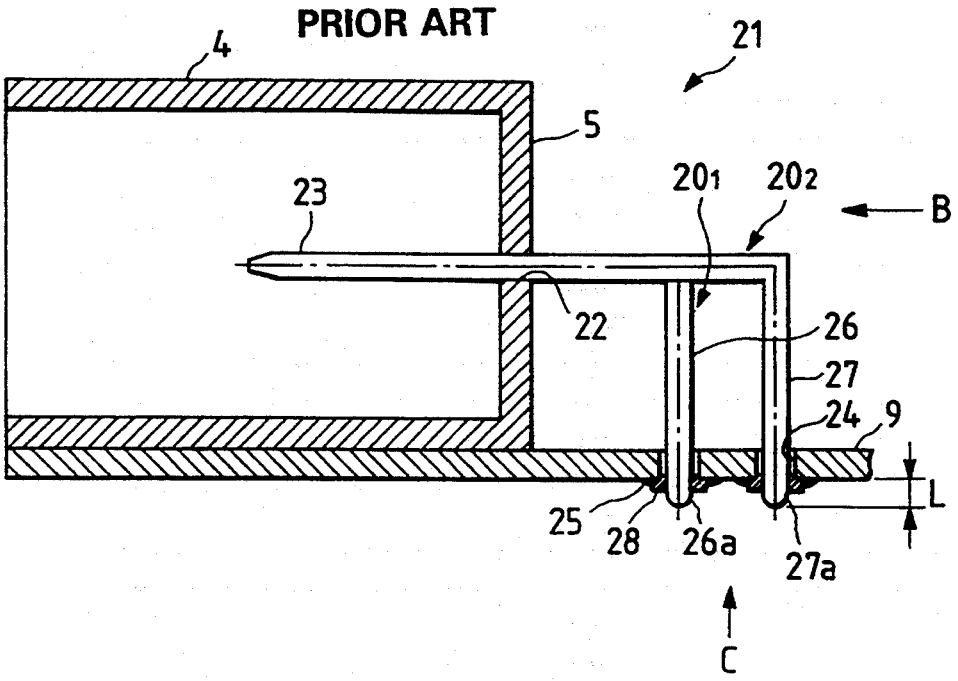
FIG. 8 PRIOR ART
FIG. 8 is a vertical cross-sectional view of a conventional example.
Figure 9:
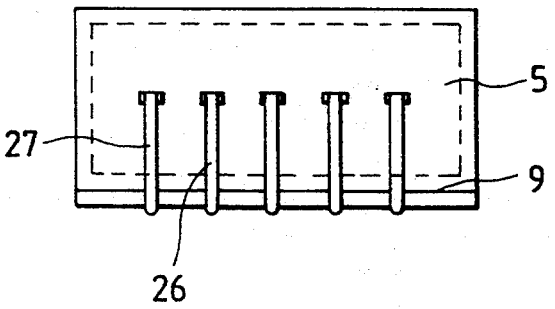
PRIOR ART FIG. 9
FIG. 9 is a rear view as seen in a direction of arrow B of FIG. 8.

In this circuit board connector 16, a plurality of pin-like terminals 2 having the same length as described above are used, and a proximal end portion 6 of one terminal $2_1$ is bent perpendicularly, and a proximal end portion 17 of the other terminal $2_3$ is bent in a two-stage manner such that a proximal end portion *17a* is disposed just at the side of a vertical proximal end portion *6a* of the one terminal $2_1$. A distal end portion $3_3$ of the other terminal $2_3$ is disposed at a level above a distal end portion. $3_1$ of the one terminal $2_1$ in parallel relation thereto, so that the distal end portions (electrical contact portions for a mating terminal) $3_1$ and $3_3$ are arranged in a staggered manner as shown in FIG. 7 (a view as seen in a direction of arrow A of FIG. 6).

Distal ends *3a* and *3a''* of the terminals $2_1$ and $2_3$ project at an equal distance from a proximal wall 19 of a connector housing 18, and the electrical contact portions $3_1$ and $3_3$ arranged in two rows (upper and lower rows) using one kind of pin-like terminals 2 having the same overall length.

As described above, in the present invention, the proximal end portions of the terminals having the same length are connected to the circuit board in a staggered manner, or the distal end portions of the terminals are arranged in upper and lower rows within the connector housing. Therefore, the erroneous mounting of the terminals, as encountered with the conventional construction using two kinds (long and short) of terminals, is eliminated, and the cost of producing the terminals is reduced.

What is claimed is:

1. A connector for a circuit board comprising:

a connector housing; and a plurality of terminals, distal end portions of the plurality of terminals being passed through and fixed to the connector housing, proximal end portions of the plurality of terminals being bent and being connected to the circuit board, the plurality of terminals having the same overall length before being bent, wherein an internal bend angle of one of said plurality of terminals is larger than an internal bend angle of an adjacent terminal wherein the distal end portions of the plurality of terminals are disposed in a row, and wherein the proximal end portions are disposed out of phase with each other.

2. The connector for the circuit board as claimed in claim 1, wherein said one of said plurality of terminals is bent at a portion thereof disposed closer to the connector housing than a portion at which said adjacent terminal is bent.

* * * * *